US007306289B2

(12) United States Patent
Kobayashi

(10) Patent No.: US 7,306,289 B2
(45) Date of Patent: Dec. 11, 2007

(54) SEATING APPARATUS WITH TILTED SURFACE AND THE CHAIR WITH THE SAME

(75) Inventor: Tomio Kobayashi, Kaedecho, 3-6-6, Shiogama, Miyagi (JP) 985-0084

(73) Assignee: Tomio Kobayashi, Shiogama Miyagi (JP)

( * ) Notice: Subject to any disclaimer, the term of this patent is extended or adjusted under 35 U.S.C. 154(b) by 93 days.

(21) Appl. No.: 10/998,241

(22) Filed: Nov. 29, 2004

(65) Prior Publication Data

US 2005/0127737 A1 Jun. 16, 2005

(30) Foreign Application Priority Data

Dec. 10, 2003 (JP) ..... 2003-436447
Aug. 11, 2004 (JP) ..... 2004-234390

(51) Int. Cl.
*A47C 7/50* (2006.01)
*A47C 16/00* (2006.01)

(52) U.S. Cl. ..... 297/423.12; 297/423.4; 297/423.13; 297/313

(58) Field of Classification Search ..... 297/423.11, 297/423.13, 423.12, 423.17, 337, 313, DIG. 10, 297/423.4
See application file for complete search history.

(56) References Cited

U.S. PATENT DOCUMENTS 2,884,991 A * 5/1959 Bloomquist ..... 297/377
3,659,897 A * 5/1972 Wright ..... 297/337
4,231,135 A * 11/1980 Fradin ..... 16/225
4,848,841 A * 7/1989 Giselsson ..... 297/423.13
5,082,327 A * 1/1992 Crisp ..... 297/313
5,265,292 A * 11/1993 Underell ..... 5/419
5,342,116 A * 8/1994 Walton ..... 297/466
5,423,280 A * 6/1995 Kelley ..... 114/363
6,139,567 A * 10/2000 McCarty et al. ..... 606/237
6,702,383 B2 * 3/2004 Newman et al. ..... 297/313
6,811,225 B1 * 11/2004 Konya et al. ..... 297/423.13
7,063,386 B2 * 6/2006 Dowty et al. ..... 297/338
7,090,303 B2 * 8/2006 Kropa ..... 297/466
2003/0025374 A1 * 2/2003 Moore ..... 297/344.12

* cited by examiner

*Primary Examiner*—David Dunn
*Assistant Examiner*—Tania Abraham

(57) ABSTRACT

The invention provide the seating apparatus to be used on the chair of the horizontal sitting base plate in order to avoid the lower back pain. By sitting on the seating base plate tilted forward from 5 to 45 degree, the person can keep the angle between the spine and the thigh from 95 to 135 degree. As the seating apparatus is equipped with the knee front holder connected with the supporting part, which is connected with the seating base plate by the half fixed joint at an another end of the supporting part, the slip down of the body on the seating base plate is stopped by the knee front holder and the steady sitting is available.

2 Claims, 13 Drawing Sheets

SEATING APPARATUS WITH TILTED SURFACE AND THE CHAIR WITH THE SAME

BACKGROUND OF THE INVENTION

1. Field of the Invention

The present invention relates to a seating apparatus used on the chair and to the chair with the said seating apparatus structure.

2. Description of Related Art

The sitting plane of the chair is usually situated parallel to horizontal plane as shown in FIG. 35. FIG. 35 is the schematic diagram of the chair with the person who sits on it. Though the sitting plane of the relaxing use chair is slanted to the backward lower and the chair back is declined backward to be able to sit lying on his back, the office chair used in front of the office desk has the horizontal sitting base plate in order to look at the documents straight.

As the sitting base plate of the chair is situated almost parallel to the horizontal plane, the angle between the spine 1 and the thigh 2 of the sitting person is smaller than about 100 degrees and almost near to 90 degrees in usual case as seen in FIG. 35.

When we sit long hours in this position, it comes the stress around the waist and comes at last the lower back pain. Concerning about an example way to avoid such kinds of the back pain, the posture improving ways to insert the seating pad or cushion under the hips in order to enlarge the angle between the spine and the thigh can be seen in U.S. Pat. Nos. 6,413,194 and 5,402,545, in which the section shape of the cushion is tapered forward in order to enlarge the angle between the spine and the thigh over 90 degrees. The method to insert the spacers of wedge shape section is presented in Japanese Patent Application Publication Laid-Open No. 2000-79135. The example of the spacer with springs is presented in Japanese Patent Application Publication Laid-Open No. 1999-244099.

On the other hand, a sit knee chair is known as the one which enables the person to sit with the angle from about 110 to 135 degrees between his or her spine and thigh, and which is composed of the seating plane tilted forward about 10 to 30 degrees and the knee supporting plane tilted in the reverse direction against the seating plane. An example of sit knee chair can be seen in U.S. Pat. No. 4,589,699 and has the feature that several tens of percent of sitting person's body weight fall on the knee supporting plane, and the sitting person's body is prevented to slip down the seating plane and given a steady sitting situation. Another example of sit knee chair is called as balans chair by STOKKE Company or HAG Company and could be seen in Internet URL:http://www.malsyo.co.jp/balans.html on Nov. 5, 2003.

The other type of chair for curing or preventing the lower back pain, in which the sitting plane is tilted or moved automatically, are presented in Japanese Patent of No. 3,106,360 and No.2,524,462.

[Patent Document 1]

U.S. Pat. No. 6,413,194

[Patent Document 2]

U.S. Pat. No. 5,402,545,

[Patent Document 3]

U.S. Pat. No. 4,589,699

[Patent Document 4]

Japanese Patent Application Publication Laid-Open No. 2000-79135.

[Patent Document 5]

Japanese Patent Application Publication Laid-Open No. 1999-244099

[Patent Document 6]

Japanese Patent of No. 3,106,360

[Patent Document 7]

Japanese Patent of No.2,524,462.

BRIEF SUMMARY OF THE INVENTION

However, the chair with the knee supporting plane to prevent the person sliding down on the seating plane, which is called as sit knee chair, is un-convenient to perform the work by sitting in front of the desk for the person who don't feel a lower back pain. From this reason, the office chair 4 shown in FIG. 35 is usually selected as the chair co-used by many persons with out a lower back pain together with the less persons with the lower back pain.

And, the chair with automatic tilting or moving mechanism of the sitting plane, shown in the Japanese Patent of Number 3,106,360 or 2,524,462, has the problem of the expensive cost and the bigger size compared to the ordinary office chair.

On the other hand, the way to insert the seating pad, cushion or the wedge shaped spacer, as shown in Japanese Patent Application Publication Laid-Open No. 2000-79135 or No. 1999-244099, enables to sit with tilting forward angle of 5 to 10 degrees. But, the larger angle as like as the case of sit knee chair cannot be applied because of that the hips slip down the seating surface to un-steady sitting. From this reason, the person who feels the lower back pain is obliged to sit on the ordinary office chair 4 in FIG. 35, which has the usually horizontal sitting plane.

Accordingly, the object of the present invention is to offer the seating apparatus which can be used for the person with lower back pain to sit with the angle over 95 degrees, for example 95 to 135 degrees, between the spine 1 and the thigh 2, and which is also equipped with the function to prevent the person slipping down the seating surface plane even on the tilted surface of high angle.

It is another object of the present invention that the said seating apparatus can be used even on the conventional swivel chair. Free rotation of the sitting person is actualized together with the sitting angle of 95 to 135 degrees between the spine 1 and the thigh 2. When the person sits with the seating apparatus of the present invention, the spine is almost vertical to the horizontal plane and the rotation of the chair is actualized together with the steady sitting without the slipping down the sitting surface plane.

By using the seating apparatus of the present invention, the person who feel the lower back pain is able to sit comfortably and even the person who doesn't feel lower back pain becomes to decrease feeling the stress around the waist after long sitting and to prevent breaking out lower back pain It is still another object to offer the chair equipped with the mechanism described above from the beginning. It is possible to add the function of selecting the angle between the sitting base plate and the horizontal plane from 5 to 45 degrees freely by introducing the mechanism of the present invention into the conventional office chair from the beginning.

After various investigations to solve the problem, it was found that the seating apparatus with at least three elements of construction is essentially effective to give the seating without lower back pain. The first element is the seating base plate, which is situated to tilt forward down under the seating person's hips. The second element is a knee front holder, which stops the person's body to slip down the seating base plate by supporting the weight near at the front side of the knee. The third element is the supporting part connected with the said knee front holder, which works as the supporting part for the knee front holder and, at last, for supporting the some part of the body weight itself.

The supporting part connected with the knee front holder has a kind of half fixed joint on the opposite side end from the knee front holder between the supporting part and the seating base plate, which includes for example, the structure of one set of hollow and projection engagement situated at the back surface of the seating base plate. The half fixed supporting part cannot be away from the seating base plate over the distance set up before, and the supporting part makes also the knee front holder not to be away from the seating base plate and, at last, to stop the body seated on the seating base plate slipping forward down.

The important advantage of the present invention is that the sitting with less stress around spine and lower back can be obtained by setting this invented seating apparatus on the fundamentally horizontal sitting base plate of the office chair. The use of this seating apparatus contributes to prevent the break out of the lower back pain and make the person with lower back pain feel it less than the sitting without this apparatus.

Another advantage of the present invention is the steady sitting situation actualized by stopping the body to slip down the seating base plate, which is given by the new structure with at least the seating base plate, the knee front holder and the supporting part. The comfortable support is actualized through the knee front holder.

Still another advantage of the present invention is that the concept of the invention can be applied on the chair itself from the beginning. The installation of the composition of the seating apparatus into the chair enables to enlarge the angle between the spine and the thigh from 95 to 135 degrees and to sit with less stress around the lower back.

Some detailed examples of the present invention to actualize in best way are explained here. The first one of the three essential composing elements of the present invention is the seating base plate, which is tilted forward down and the hips are set on. This plate has the feature that the angle between the seating base plate and the seating bottom plate is ranged from 5 to 45 degrees and this construction enables the situation to keep the seating base plate as tilted 5 to 45 degrees against the horizontal plane, when the seating apparatus is set on the horizontal sitting plate of the chair.

Concerning about the angle between the seating base plate and the bottom plate, it is suitable to keep over 5 degrees because of the effectiveness of preventing lower back pain. It is much more suitable to keep over 10 degrees for higher effectiveness against long hours sitting.

On the other hand, the larger angle than 45 degrees is not suitable, because the too much weight is loaded against the knee front holder, as the reaction, and against the knee front itself. For getting the moderate weight balance to the knee and the hips, and also the comfortable posture for the long hours sitting, the smaller angle than the 45 degrees is selected.

Still concerning about the angle of the seating base plate, it is not limited only for one angle value from 5 to 45 degrees. The apparatus structure capable of selecting the various angle depending upon the body condition on the various occasions is much more effective. In order to release the lower back stress on the various situation of the lower back muscle, the selectiveness of the angle is used for giving the movement of stress balance around the waist and very effective to prevent the lower back pain.

The second one of the essential composing elements is the knee front holder. This implies the part of the seating apparatus, which is contacted with the front leg surface near the knee and support the body weight not to slip down the tilted seating base plate. Because the knee front holder is composed as jointed with the supporting part of the third essential composing element of the present invention, it is also possible to make the knee front holder as formed in the one piece together with the supporting part.

Concerning about another way to construct the knee front holder at one end portion of the supporting part, screw and nut connection or insertion joint method can be applied, too. For the still another construction, attaching the other part of larger contact area to the knee is applicable. The larger holding part of the knee front holder onto the thinner end portion of the supporting part is effective to disperse the force against the knee, and covering the end portion by the soft cushion material is also recommendable to weaken the impact against the knee. In this specification, the words of knee front holder are used as they mean the all the types of the one end portion of the supporting part, which work for holding the knee front. In another words, they include the case that the knee front holder is made of the same material as the supporting part and made in the simultaneous injection process. And they also include the case that the cushion material to enlarge the contact area against the knee front is attached onto the central area of the knee front holder itself. They are named totally as the knee front holder in this specification.

The third of the three essential elements of the present invention is the supporting part, which is constructed with the knee front holder jointed. Through the supporting part, some tens percent of the body weight to slip down the seating base plate are transferred to the back surface portion of the seating base plate and the body is stopped to slip down. The distance between the knee front holder and the center position of the seating base plate can be changed by moving the connected position of the supporting part with the seating base plate. And this movable mechanism leads both the long thigh person and the short thigh person to sit comfortably respectively.

One of the concrete structure of the end portion of the supporting part opposite from the knee front holder is a set of hollow and projection engagement, which are engaged together not to be apart but to be able to slip around the projection mutually. By engaging the hollow or the projection at the end portion of the supporting part with the projection or the hollow situated at the back surface of the seating base plate respectively, the knee front holder at another end of the supporting part cannot be away from the seating base plate over some restricted distance. These engagements by round hollow and round projection enable the sure transfer of the force by body weight and prevent the body slip forward down on the seating base plate.

Lining up the several engagement points of hollow or projection from the front to the back at the back surface of the seating base plate, the distance between the center of the seating base plate and the knee front holder can be changed by adapting the length of the sitting person's leg. As the engagement points are situated at the back surface of the seating base plate, this construction is convenient to sit because of the absence of the protruding portion over the seating base plate.

Another structure for composing the supporting part is to hook the bent end portion of the supporting part into the hole situated at the side surface of the seating base plate. This has the feature that the simplicity of the structure enables the cheaper cost to make compared to the one with the hollow and projection engagement at the back surface of the seating base plate. Still another structure of the supporting part, in which the curled end portion of the supporting part is hooked around the circle plate or short pipe under the seating base plate, is also effective to actualize the simple one.

One of the other structures for the supporting part is the one made of a cord or a belt, which is jointed with the knee front holder through the thin rod or wire and can be wound around the winding axis at the end portion opposite from the knee front holder. The both end portions of the winding axis are inserted into the each bearing situated under the seating base plate, and the relative distance between the knee front holder and the center of the seating base plate can be shortened by winding up the said cord or belt. On the other hand, the distance between the knee front holder and the seating base plate can be enlarged by rewinding the cord or belt. And the adjustment coping with the length of the sitting person's thigh can be set by rotating the winding axis.

After setting the appropriate distance, the winding axis is fixed not to rotate and not to make the knee front holder be away from the seating base plate over the pre-adjusted distance. Concerning about the way to stop the rotation of the winding axis, a set of hollow and projection engagement can be applied, which is situated on the axis and at the back side portion of the seating base plate respectively. The way to insert a pin passing through both the axis and the back side portion of the seating base plate is also applicable.

Still the other types of the supporting part can be actualized by the following structures. The supporting part is made of the cord itself and the half fixed joint portion is made by connecting a metal hook part or a clip part and also by making the big knot at the end portion of the cord opposite from the knee front holder. These half fixed joint portions are hooked into the hole or the ring, and also around the projected portion situated at the back or the side surface of the seating base plate.

The above explained engagement or the hooking are set in half fixed joint situation and the rotation of the engagement portion or the hooking portion is available. Owing to these half fixed joints, even though the body being stopped to slip forward down the seating base plate, the freedom to open or close the both knees is available and the comfortable sitting is achieved. The rotation of the half fixed joint portion is also possible in the case of using the cord or the belt as the supporting part.

Still the other structure of the present invention is presented here, which is possible to set on the office chair and possible to fold down into the small size for the better portability. This structure is actualized by connecting the individual part with flexible sheet material at least at two connecting portions. The first of the connecting portions is the one between the seating base plate and the seating bottom plate. The second is the one between the tilting angle adjusting plate and the seating bottom plate or the one between the tilting angle adjusting plate and the seating base plate. This structure is also adopted the knee front holder of the style to cover around the knee by the flexible cloth and fix it to the supporting part made of the cord or belt. By preparing this structure, the seating apparatus can be built up on using and can be flatten on carrying.

DETAILED DESCRIPTION OF THE INVENTION

Hereinafter, the preferred embodiments of the present invention are described precisely by using the figures. The six examples are described below by using the FIG. 1 to 11, FIG. 12 to 15, FIG. 16 to 17, FIG. 18 to 24, FIG. 25 to 28 and FIG. 29 to 34 respectively.

FIRST EXAMPLE

Figure 1:
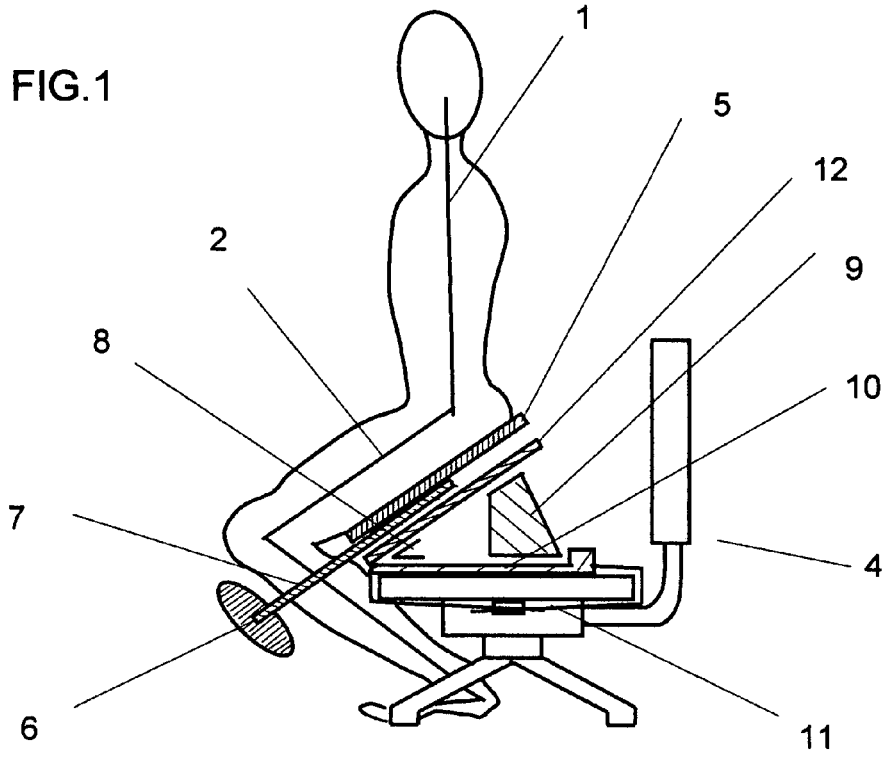
FIG. 1 is a schematic sectional view illustrating the posture of the person sitting on the office chair with the seating apparatus of the present invention.

FIG. 1 is a schematic sectional view illustrating the posture of the person sitting on the office chair 4 with the seating apparatus of the present invention. As the FIG. 1 is illustrated schematically to be able to understand the entire relation among the related parts, the sections of the various parts at the individual peculiar section plane are shown and arranged together without showing one common section at an absolute common plane.

In FIG. 1, a seating apparatus by the present invention is composed of the seating base plate 5, the knee front holder 6, the supporting part 7, the hinge 8, the slanted block 9, the seating bottom plate 10, the fixing belt 11 and the seating back plate 12. And as explained precisely later, the seating base plate 5 is situated parallel to the seating back plate 12 and kept away some distance. The knee front holder 6 is connected with the supporting part 7, and another end portion of the supporting part 7 opposite from the knee front holder 6 is inserted into the space between the seating base plate 5 and the seating back plate 12.

Figure 2:
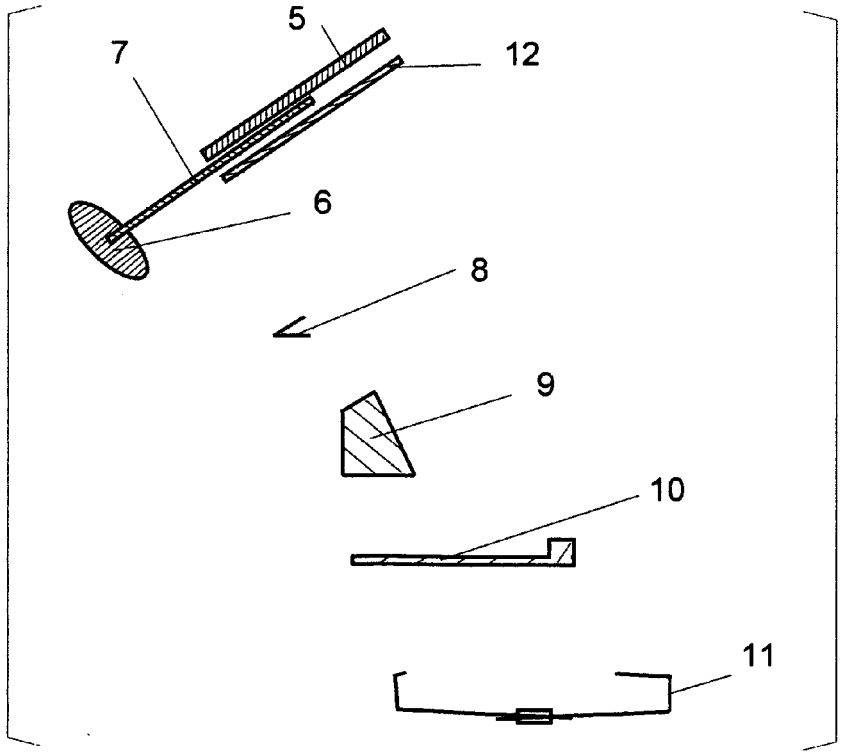
FIG. 2 is schematic sectional view of the part elements of the seating apparatus in FIG. 1, which are shown separately one by one.
Figure 3:
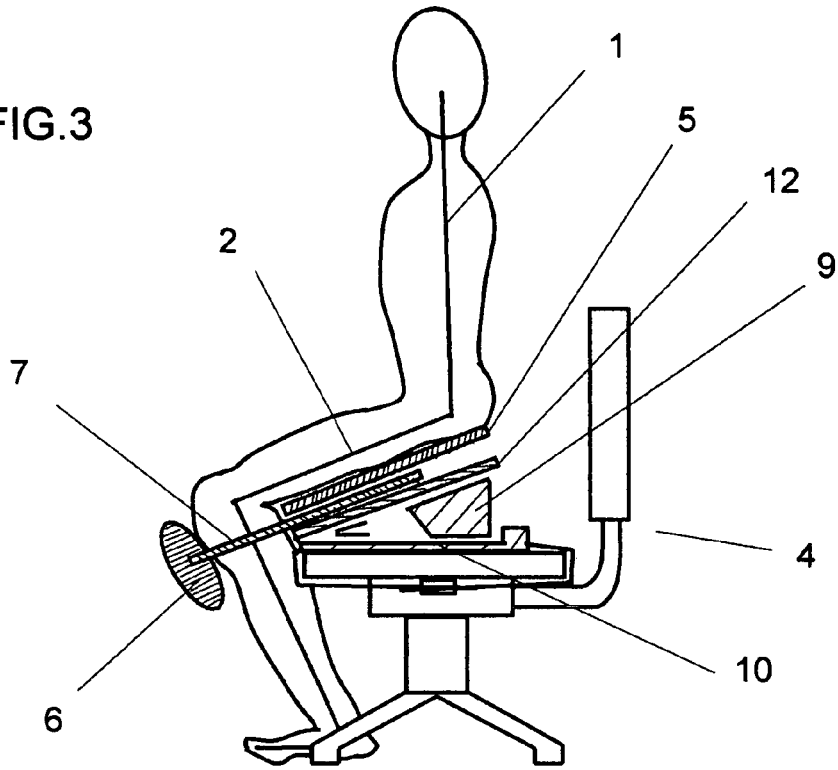
FIG. 3 is another schematic sectional view illustrating the posture of the person sitting on the office chair with the seating apparatus of the present invention in the different case to FIG. 1.

FIG. 2 is a schematic sectional view of the element parts of the seating apparatus in FIG. 1, which are shown separately one by one. The front tip portion on the back face of the seating back late 12 is connected with the seating bottom plate 10 by the hinge 8 and the angle between the two plates can be set freely. The slanted block 9 is inserted into the space between the seating back plate 12 and the seating bottom plate 10 in order to keep the angle between the two plates and to support the body weight.

By applying the different angle and height on the slanted block 9, the tilted angle between the seating base plate 5 and the seating bottom plate can be changed. The example of about 35 degree is shown in the FIG. 1 and the example for 18 degree is shown in the FIG. 3. As the slanted block is stopped to slide back on the rear portion of the seating bottom plate 10 by the block stopping portion 13 as shown in enlarged schematic section view of FIG. 4, the steady sitting is actualized.

The seating bottom plate 10 is fixed on the sitting base plate of chair by the fixing belt 11 connected with the front tip and the back tip portions of the seating bottom plate. Though the one belt is illustrated in the FIG. 1 and FIG. 2, the two belts or the forked belt into two branches also can be used according to the shape of the chair.

Figure 4:
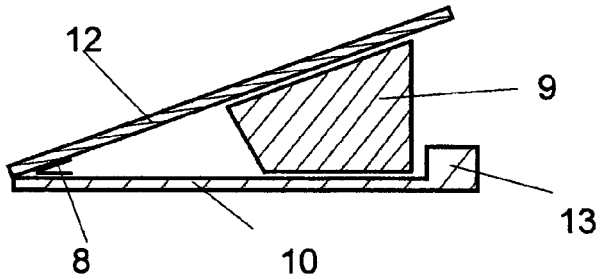
FIG. 4 is a schematic sectional view illustrating the arrangement of the seating back plate, the slanted block, the hinge, the seating bottom plate and the stopper for the slanted block.
Figure 5:
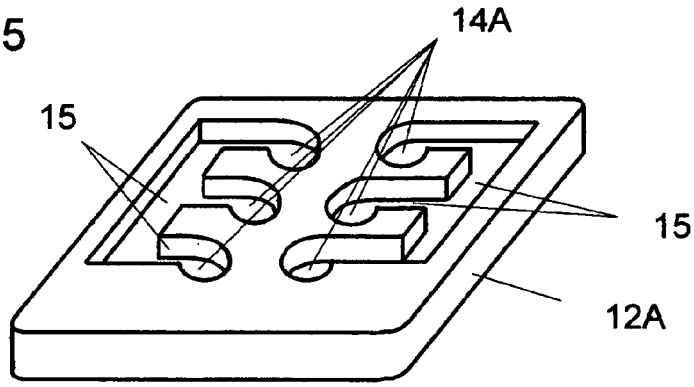
FIG. 5 is a perspective top view of the upper face of the seating bottom plate in the first example.

Next, the connecting structure of the seating base plate 5 and the seating back plate 12 is precisely explained. The schematic section view of the seating back plate 12 connected with the seating bottom plate 10 by the hinge 8 is illustrated in FIG. 4 and the enlarged precise schematic view of the seating back plate 12A is shown in FIG. 5. The upper face of the seating back plate 12A, that is, the face opposite from the seating bottom plate 10 is formed the hollow portion 14A of the follow and projection engagement and the slide groove 15 successively. For example, when the thickness of the seating back plate 12A is 10 mm, the depth of the slide groove is formed as 5 mm.

Figure 6:
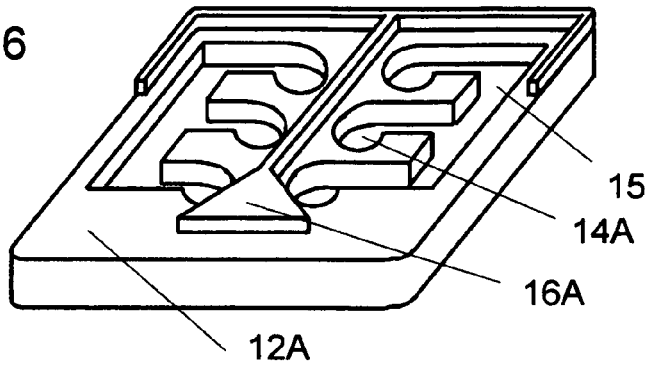
FIG. 6 is a perspective top view of the seating plate spacer situated on the seating bottom plate in the first example.

Next, the seating plate spacer 16A is put on the seating back plate 12A as shown in the FIG. 6. The position of the seating plate spacer is apart from the edge of the slide groove 15 and the hollow portion 14A by the distance of about 5 mm. This position enables the brim portion around the projection 17A in the FIG. 7 rotate and move along the groove smoothly, when the supporting part 7A is situated between the seating upper plate and the seating back plate and the projection portion is inserted into the hollow or groove portion. The thickness of the seating plate spacer 16A is made a little thicker, for example 6 mm, than the supporting part 7A thickness, for example 5 mm. The seating plate spacer 16A is fixed with adhesive to be sandwiched by the seating back plate 12A and the seating base plate 5A.

Figure 7:
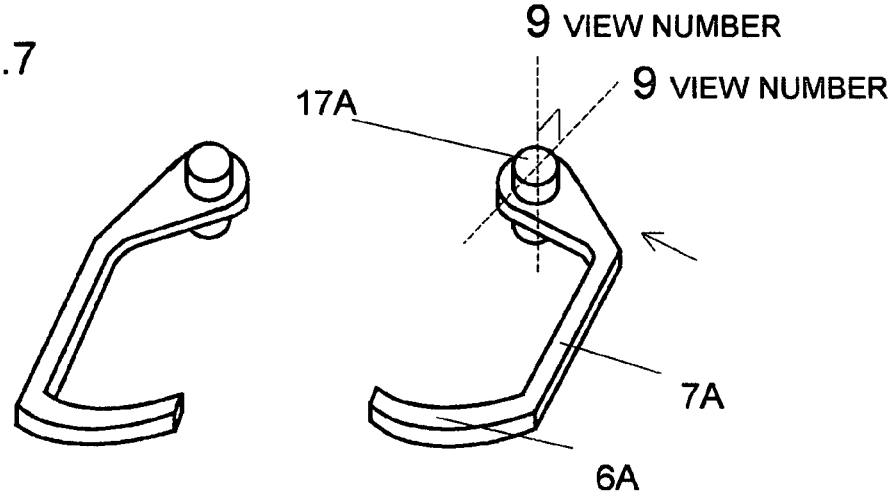
FIG. 7 is a perspective top view of the supporting part in the first example.

An enlarged schematic view of the supporting part 7A in FIG. 7 shows that the supporting part has the knee front holder 6A on one end portion of the supporting part, and has the projection portion 17A of the hollow and projection engagement on another end portion of the supporting part. The thickness of the knee front holder 6A is made as thick as the supporting part 7A, when formed by cutting from the same wooden board as shown in FIG. 7. On the other hand, the wider contacting surface area of the knee front holder can be made with the thinner portion of the supporting part by using the hot molding method of the synthetic resin.

Figure 8:
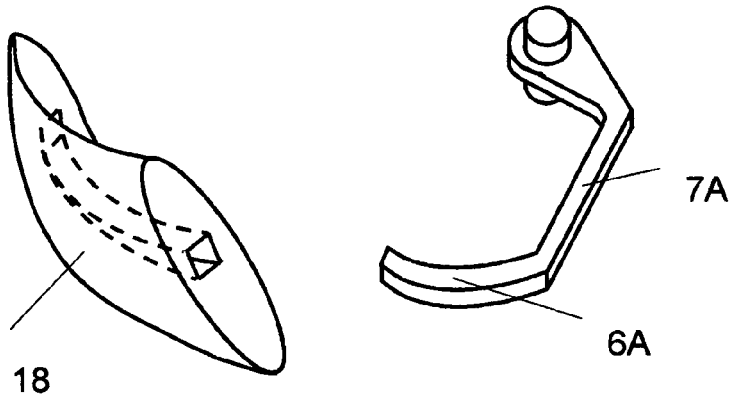
FIG. 8 is a perspective top view of the supporting part and the buffer cover for the knee front holding part in the first example.
Figure 9:
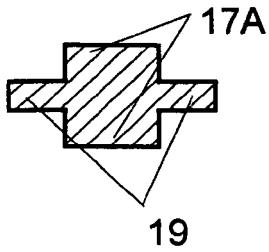
FIG. 9 is a sectional view of the projection part of the hollow and projection engagement at an end portion of the supporting part in the first example.

On both cases of wooden board cutting and hot injection resin molding, when the same thickness is used for the knee front holder and the central area of the supporting part, it is possible to enlarge the knee contact area by adapting the buffer cover for knee front holder 18 onto the knee front holder 6A as shown in FIG. 8. From this point of view, the words of the knee front holder include two cases in the specification documents of the present invention. One of the two cases is the case of the same thickness as the supporting part and the second case is the case with the buffer cover for knee front holder to enlarge the knee contact area FIG. 9 is the section view of the projecting portion 17*a* of the hollow and projection engagement in the FIG. 7. The section plane is made by the plane defined by the two broken lines of view number 9 and observed from the direction of arrow in FIG. 7. The projecting portion 17A is formed on both sides of the supporting part plane and the brim portion 19 is formed around the projecting portion.

Figure 10:
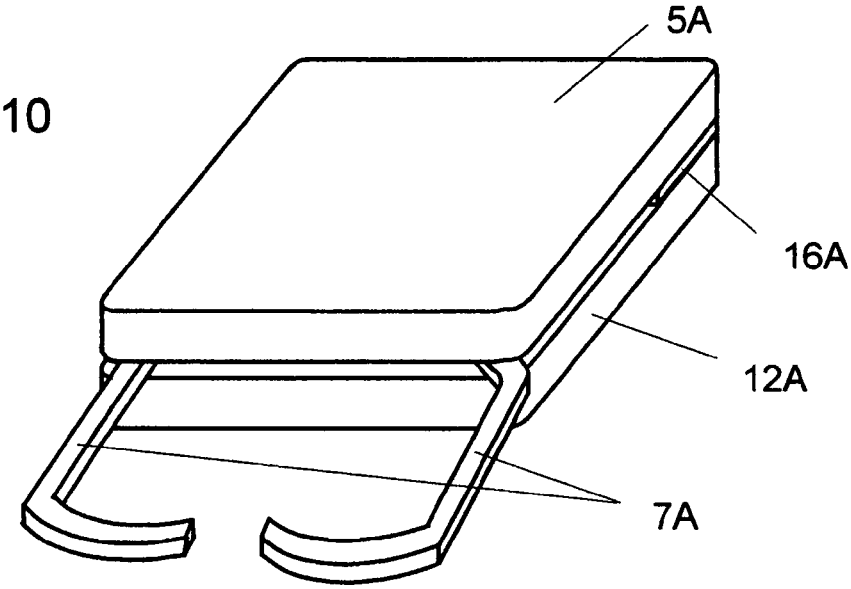
FIG. 10 is the perspective top view of the assembled parts composed of the seating base plate, the seating plate spacer, the seating back plate and the supporting parts with the knee front holder in the first example.

FIG. 10 is the perspective top view of the assembled parts of seating base plate 5A, the seating plate spacer 16A, the supporting part 7A and the seating back plate 12A. The same hollow portion 14A and the same slide groove 15 as the ones on the upper face of the seating back plate 12A are formed at the back surface of the seating base plate 5A in mirror reflected position. When the projecting portion 17A is moved into the hollow portion 14A, the projected portion cannot be moved forward anymore from the seating base plate, and the some tens percent of the body weight loaded on the knee front holder 6A are transferred to the seating base plate 5A and the seating back plate 12A through the supporting part 7A. And as the seating back plate 12A is fixed to the office chair 4 through the hinge 8, the seating bottom plate 10 and the fixing belt 11, the body is stopped to slip forward down by the knee front holder 6A.

Figure 11:
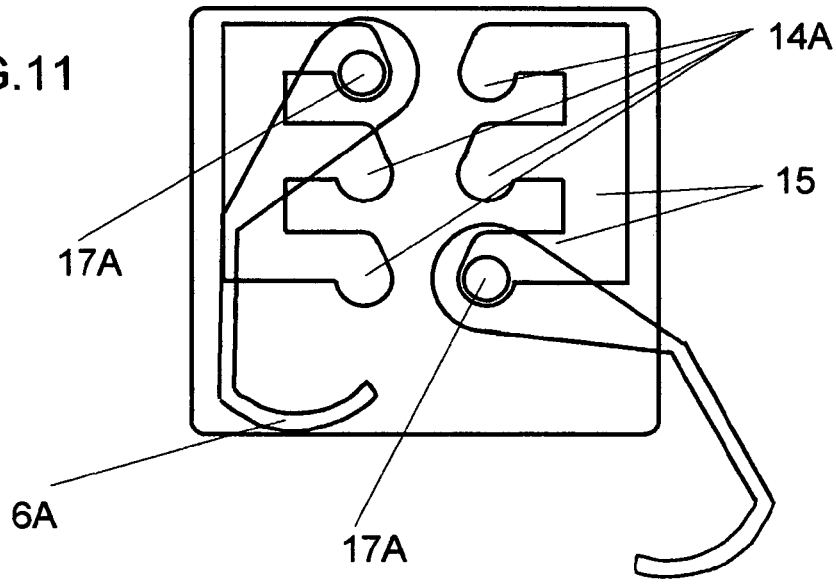
FIG. 11 is the schematic diagram to show the seeing through arrangement of the seating base plate and the supporting parts from the top surface in the first example.
Figure 12:
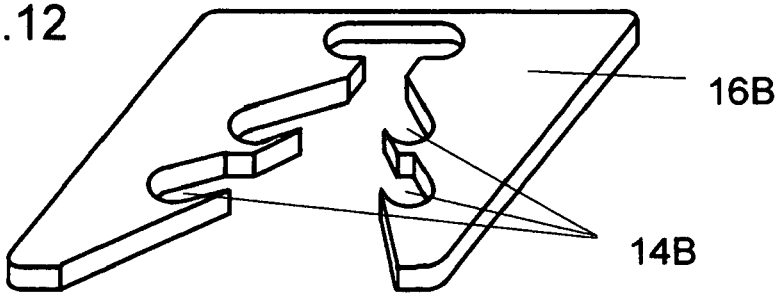
FIG. 12 is the perspective top view of the seating plate spacer in the second example.

FIG. 11 is the schematic diagram to show the seeing through arrangement of the seating base plate and the supporting parts together with the hollow portion 14A, the slide groove 15 and the projecting portion 17A from the top surface. The hollow portions 14A are formed in three steps lined from the back to the front direction, and the projecting portion 17A can be moved on the way of the slide groove 15. When the knee front holder 6A is made as same thickness as the supporting part 7A and the projecting portion is moved to the rear one in the three hollow portions, the knee front holder 6A can be almost concealed between the seating base plate and the seating back plate. This concealment gives the convenience not to obstruct the moving way, when the person is leaving the chair after being seated.

SECOND EXAMPLE

Figure 13:
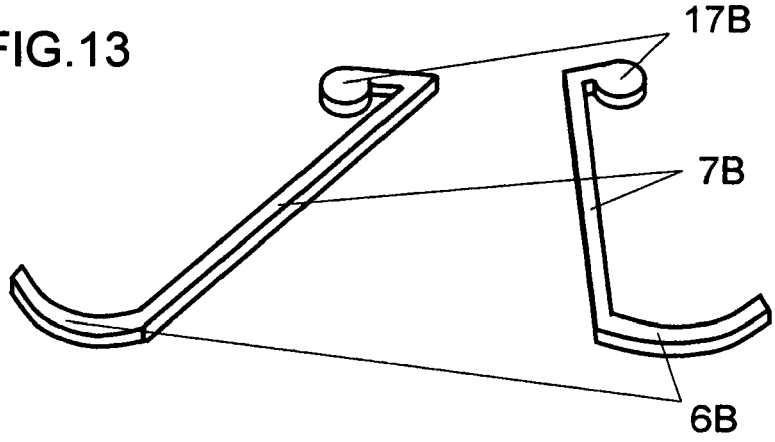
FIG. 13 is the perspective top view of the supporting -part in the second example.
Figure 14:
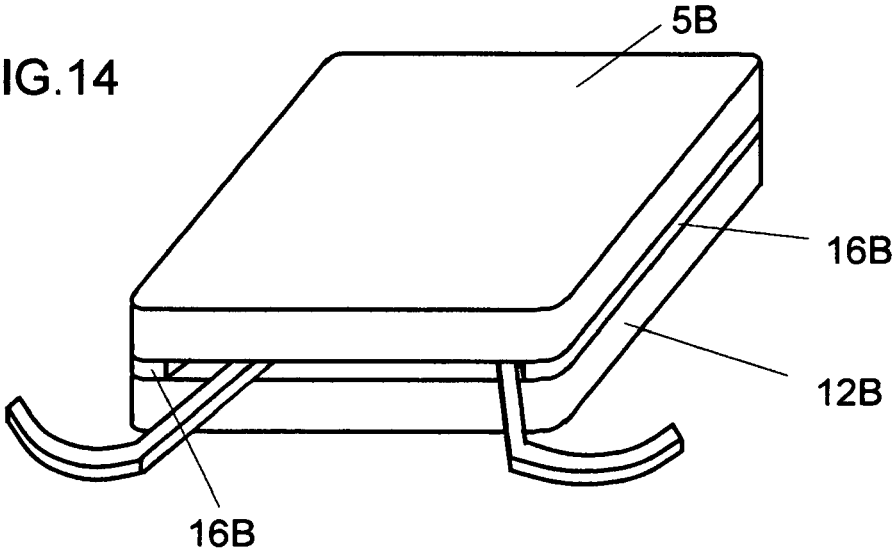
FIG. 14 is the perspective top view of the assembled parts composed of the seating base plate, the seating plate spacer, the seating back plate and the supporting parts in the second example.

Next, the second example is explained by using FIG. 12 to 15. The hollow portion 14B of the hollow and projection engagement is formed in the seating plate spacer 16B itself in FIG. 12. As shown in the FIG. 13, the knee front holder 6B and the projecting portion 17B are formed on each end of the supporting part 7B. And as shown in FIG. 14, the seating plate spacer 16B is sandwiched between the seating base plate 5B and the seating back plate 12B. As the seating base plate 5B and the seating back plate 12B have the planer surfaces, the projecting portion 17B of the supporting part can be moved in the space formed by the seating plate spacer 16B.

Concerning about the thickness example of the each planar plate, the supporting part 7B is formed by hollowing out the shape of the FIG. 13 from the 9 mm thickness board, and the seating plate spacer 16B is formed from the 10 mm thickness board. The seating base plate 5B and the seating back plate 12B are made of the 6 mm thickness board and bonded together with the seating plate spacer 16B into one body as shown in FIG. 14 by using the adhesive. As the supporting part 7B is formed thinner than the seating plate spacer 16B, the projecting portion 17B can be moved in the space and select the position from some hollow portions 14B for the comfortable sitting situation.

Figure 15:
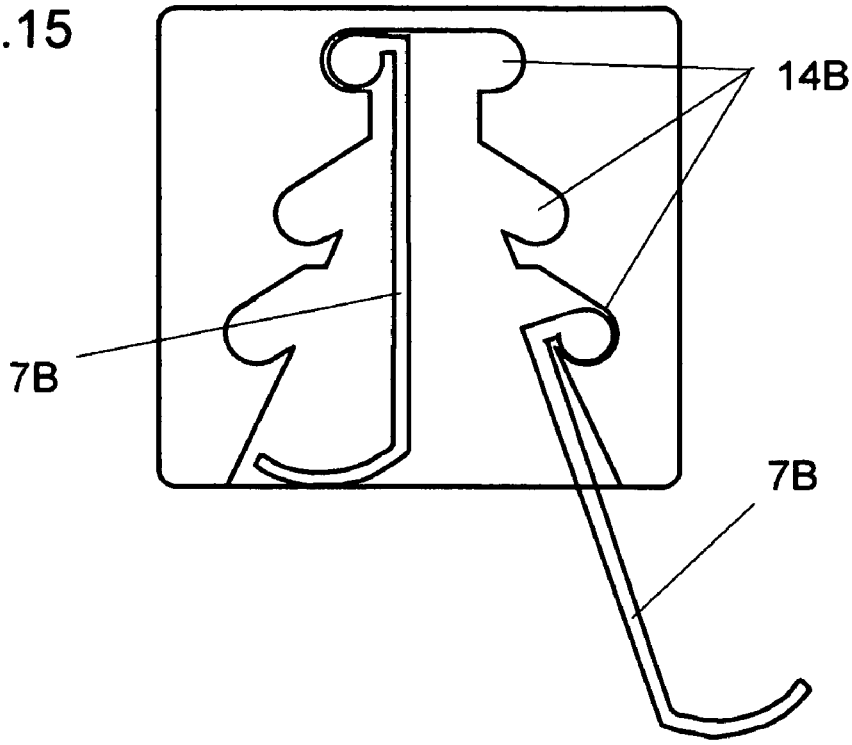
FIG. 15 is the schematic diagram to show the seeing through arrangement of the seating base plate, the seating plate spacer and the supporting parts from the top surface in the second example.

FIG. 15 is the schematic diagram to show the seeing through arrangement from the top surface of the seating base plate 5B, the seating plate spacer 16B, the supporting parts 7B and the seating back plate 12B in the second example. The hollow portion 14B can be chosen according to the length of the leg, and the projecting portion 17B cannot come out of the hollow portion 14B even the sitting person shake the legs right and left directions because of the edge shape of the hollow portion.

When the projecting portion is engaged with the rear one of the three hollow portions, the knee front holder 6B can be almost concealed under the seating base plate 5B. It is as same as the first example that the knee front holder 6B can be covered with the buffer cover for knee front holder 18 shown in the FIG. 8 and be enlarged the contact area with the knee to disperse the concentrated load. The seating back plate 12B is connected with the seating bottom plate 10 by the hinge 8.

On the other hand, the projecting portion 17B connected with the supporting part 7B can be changed with the hollow portion together with the change of the hollow portion 14B to the projecting portion in the seating plate spacer 16B. In another words, the projecting portion can be changed with the hollow portion on the condition that a pair of the hollow and the projection is supplied in an engagement. It is possible to make the projecting portion in the seating plate spacer 16B as circular plate shape together with the circular hook shape of the hollow portion at one end portion of the supporting part 7B.

THIRD EXAMPLE

Figure 16:
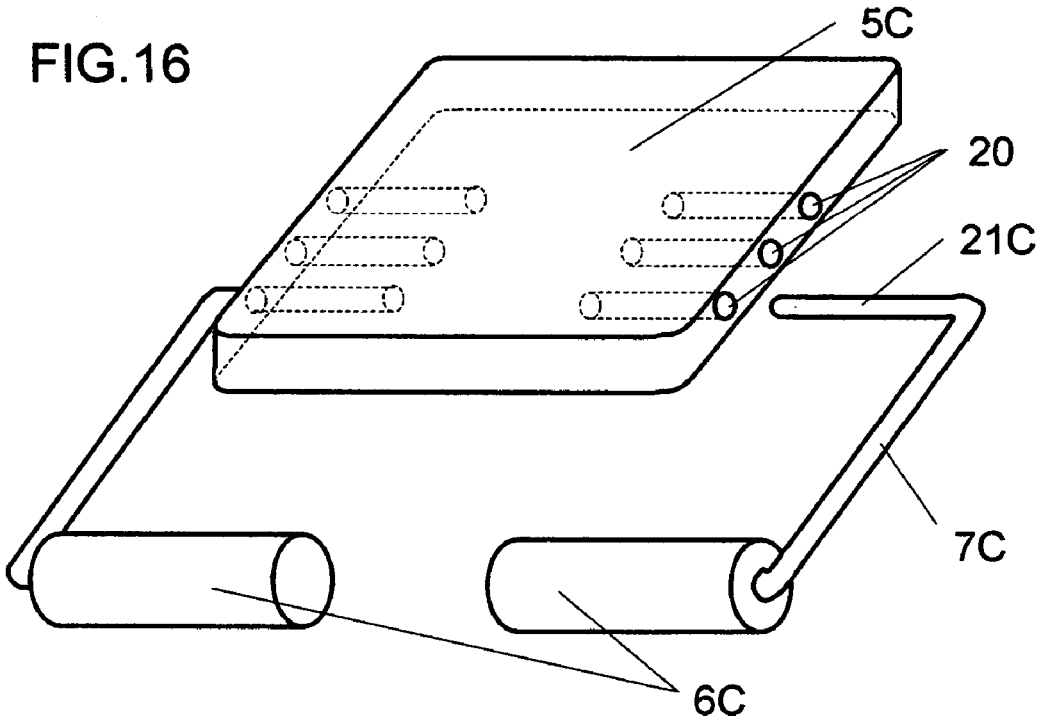
FIG. 16 is the perspective top view of the seating base plate with an attached supporting part and another detached supporting part in the third example.
Figure 17:
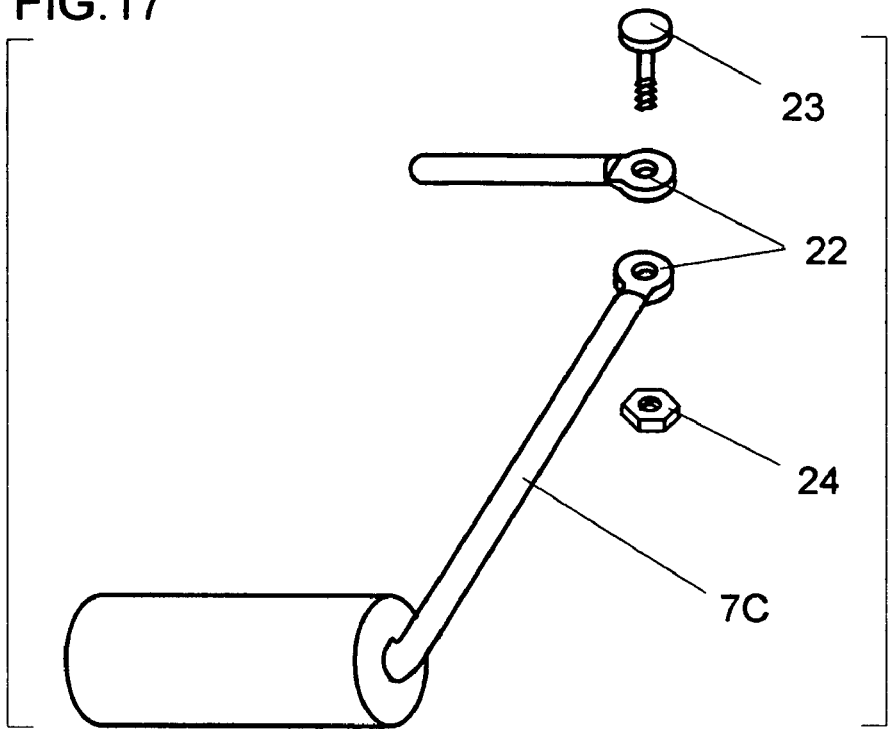
FIG. 17 is the perspective top view of a taken apart example for the supporting part in the third example.
Figure 18:
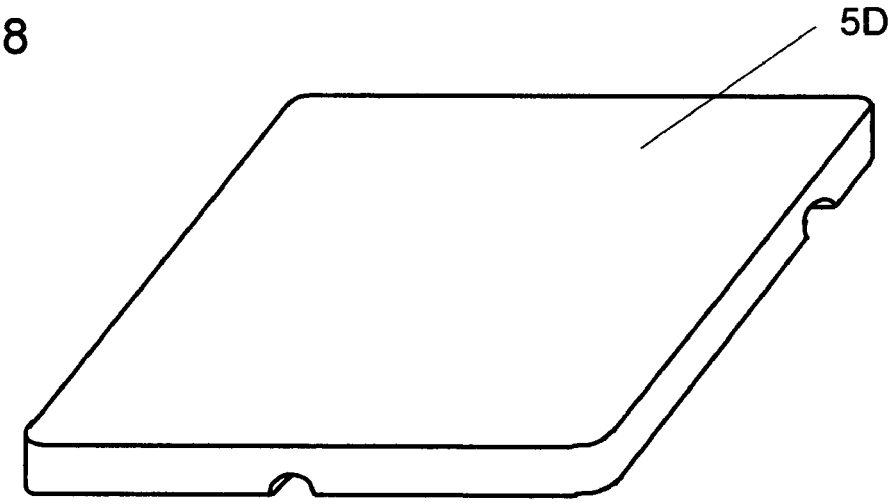
FIG. 18 is the perspective top view of the seating base plate in the fourth example.

Next, the relation between the seating base plate and the supporting part in the third example of the present invention is shown in the FIG. 16 to 17. The hole 20 is situated at the side surface of the seating base plate 5C, and the hook portion 21C is situated on the opposite end portion from the knee front holder 6C in the supporting part 7C. In the third example, the back surface of the seating base plate 5C is faced directly to the seating bottom plate 10, and the seating base plate 5C is connected with the seating bottom plate 10 at the front tip position by the hinge 8. The load onto the knee front holder 6C is transferred to the seating base plate 5C by inserting the hook portion 21C into the hole 20.

Another structure of the hook portion 21C is shown in the FIG. 17, which is jointed with the supporting part 7C by the screw hole 22 with the bolt 23 and the nut 24. By using this method of joint, the load transfer by the supporting part 7C is possible on the same time of shaking the legs to right and left directions.

FOURTH EXAMPLE

Next, the fourth example of the present invention is shown in FIG. 18 to 24. The load transfer mechanism of the fourth example is shown in the FIG. 19, and which is composed of the winding axis 25, the belt 26, the supporting bar for the belt 27 and the wire 28. These parts are situated in the space between the seating base plate 5D and the seating back plate 12D shown in FIG. 18 and FIG. 20 respectively. The load on the knee front holder 6D is transferred to the wire 28, and then to the supporting bar for the belt 27. The opposite end of the belt from the supporting bar is connected with the winding axis 25 and the belt is wound around some length. The distance between the knee front holder 6D and the winding axis 25 can be controlled by adjusting the winding length of the belt 26. In the fourth example, the supporting part 7D is composed of the wire 28, the supporting bar for the belt 27 and the belt 26, and which is connected with the load transfer parts of the winding axis 25 equipped with the projected portion for stopping axis rotation 29.

Figure 19:
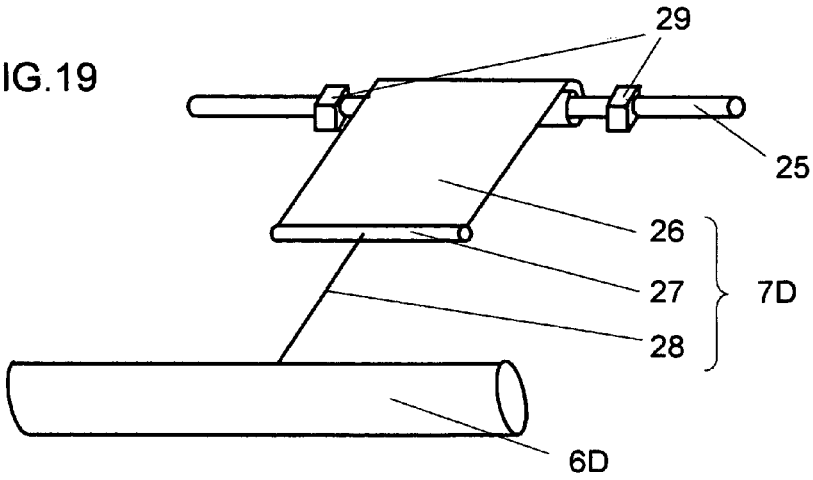
FIG. 19 is the perspective top view of the assembled supporting parts in the fourth example.
Figure 20:
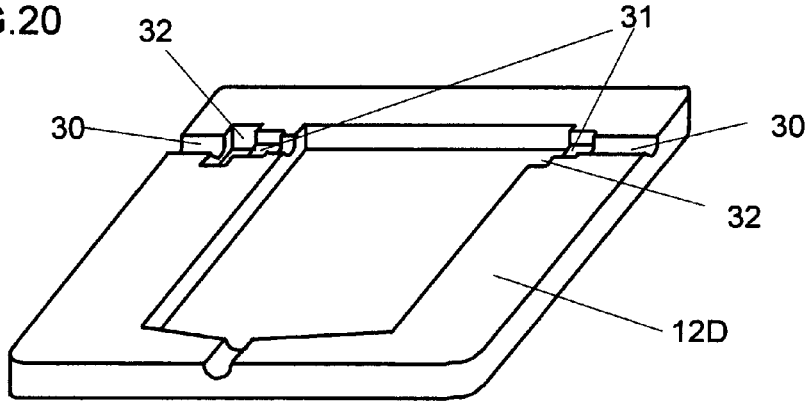
FIG. 20 is the perspective top view of the seating back plate in the fourth example.

As it is shown in FIG. 19, the winding axis 25 has the two projected portions for stopping axis rotation 29 on both sides of the wound belt position. The projected portion for stopping axis rotation has the rectangular section shape and the same center position as the winding axis 25. FIG. 20 is the schematic top view of the seating back plate 12D and used to describe below the arrangement of the winding axis, the seating base plate and the seating back plate.

The space to accommodate the winding axis 25, the belt 26 and the supporting bar for the belt 27 is formed on the upper surface of the seating back plate 12D in FIG. 20. The same shape space as the seating back plate is formed with the mirror reflected arrangement on the back surface of the seating base plate 5D. The seating base plate 5D and the seating back plate 12D are fixed by the adhesive so that the both plates keep the space for the bearing portions 30 of the winding axis on both sides and the space for the belt at center area.

Figure 21:
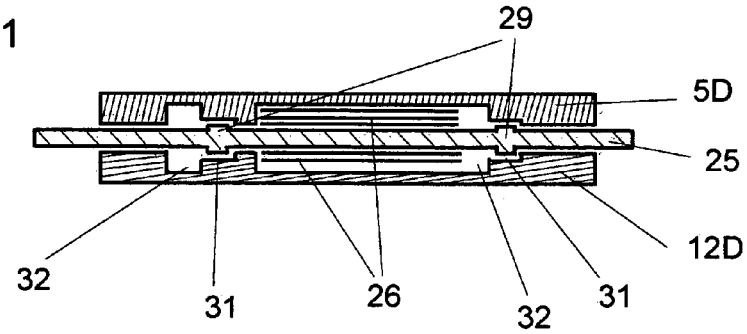
FIG. 21 is the section view of the assembled parts of the seating base plate, the winding axis, the belt and the seating back plate in the fourth example.
Figure 22:
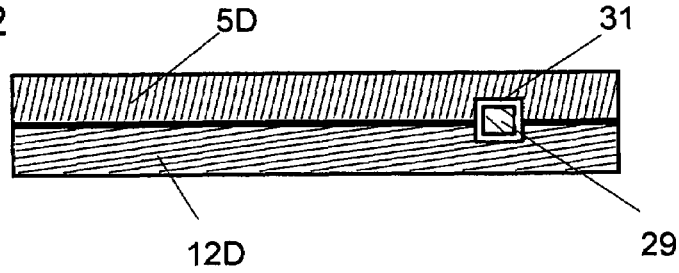
FIG. 22 is the section view of the assembled parts of the seating base plate, the seating back plate and the projected portions for stopping axis rotation in the fourth example.

The upper surface structure of the seating back plate 12D is described more precisely below. The hollow portion for stopping axis rotation 31 and the hollow portion for axis rotation 32 are situated side by side between the bearing portions on both sides of the plate. When the projected portion for stopping rotation 29 on the axis is placed at the hollow portion for stopping axis rotation 31, the rotation of the winding axis 25 is prevented. FIG. 21 is the schematic section view of the assembled parts of the seating base plate 5D, the winding axis 25, the belt 26 and the seating back plate 12D, in which the section plane is defined as the plane including the center line of the winding axis and perpendicular to the seating base plate, and the projected portion for stopping rotation 29 on the winding axis is just placed at the hollow portion for stopping axis rotation 31. FIG. 22 is another section view on the same time as FIG. 21. Though the projected portion for stopping rotation 29 on the winding axis is just placed at the hollow portion for stopping axis rotation 31, the section plane is perpendicular to the winding axis and at the position including the projected portion for stopping rotation 29 and the hollow portion for stopping axis rotation 31.

Figure 23:
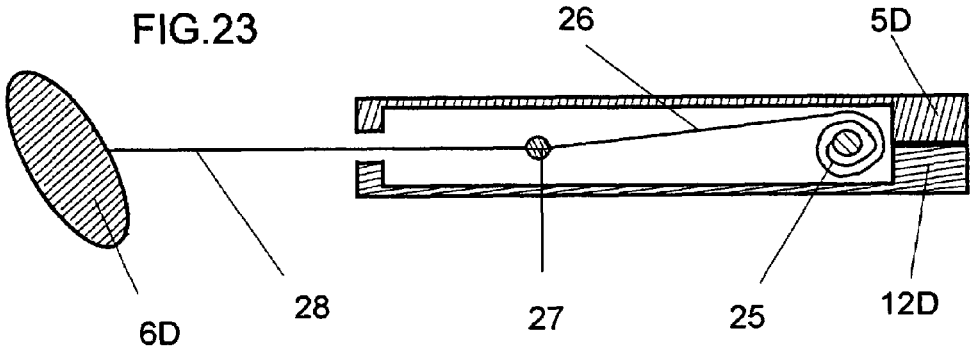
FIG. 23 is the section view of the assembled parts of the seating base plate, the winding axis, the belt, the connecting bar for the belt end portion, the wire, the knee front holding part and seating back plate in the fourth example.
Figure 24:
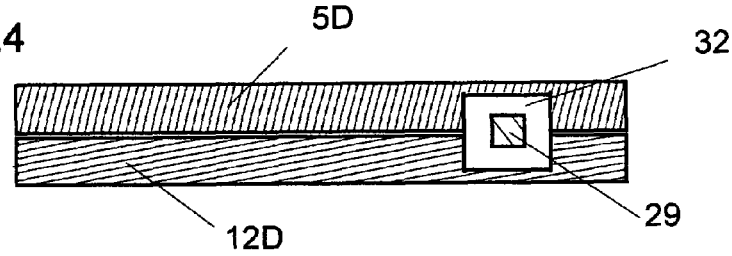
FIG. 24 is the section view of the assembled parts of the seating base plate, the seating back plate and the projected portions for stopping axis rotation in the fourth example on different time from FIG. 22.

FIG. 23 is the schematic section view of the section plane which is including the center of the wire 28 and the knee front holder 6D, and perpendicular to the winding axis 25. FIG. 24 is the schematic section view by the other section plane, which is including the projected portion for stopping rotation 29 and perpendicular to the winding axis 25, and just on the time the projected portion for stopping rotation 29 is placed at the hollow portion for axis rotation 32. When the projected portion for stopping rotation 29 is placed at hollow portion for axis rotation 32, the projected portion for stopping rotation 29 can be rotated, and the distance between the seating base plate 5D and the knee front holder 6D can be adjusted by winding up or down the belt according to the length of the sitting person's leg.

FIFTH EXAMPLE

Figure 25:
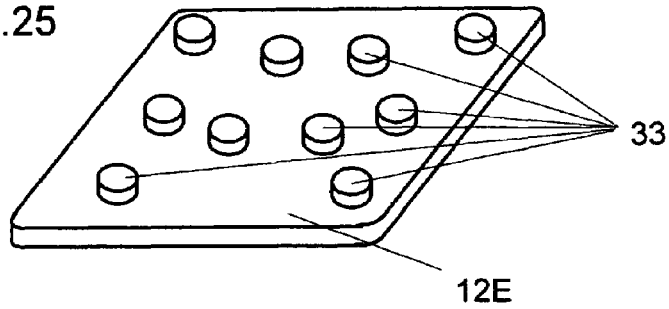
FIG. 25 is the schematic top view of the seating back plate with the small circle plates on its surface in the fifth example.
Figure 26:
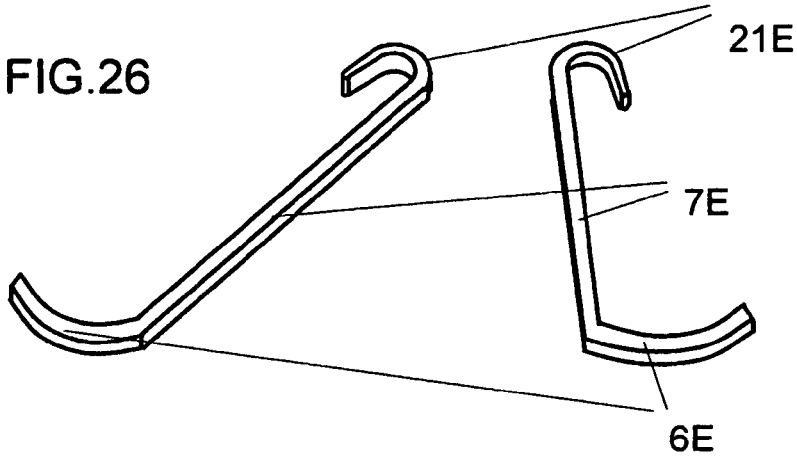
FIG. 26 is the schematic top view of the supporting parts in the fifth example.

Next, the fifth example of the present invention is explained by using FIG. 25 to 28. As shown in FIG. 25, several pieces of the circle plate 33 on the seating back plate 12E have the function of the seating plate spacer. The hook portion 21E of a half circle shape is formed on the end portion opposite from the knee front holder 6E of the supporting part 7E in FIG. 26.

Figure 27:
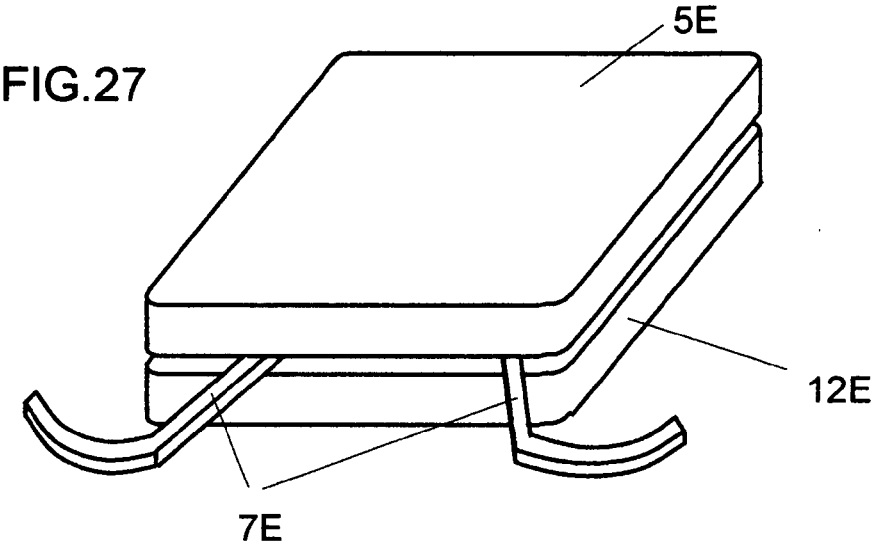
FIG. 27 is the schematic top view of the assembled parts of the seating base plate, the supporting part and the seating back plate in the fifth example.
Figure 28:
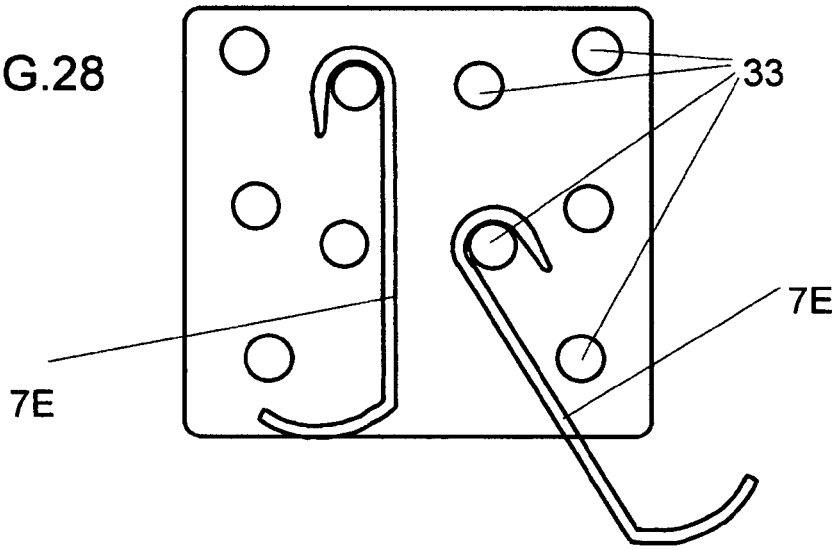
FIG. 28 is the schematic diagram to show the seeing through arrangement of the seating base plate, the circle plates and the supporting parts from the top surface in the fifth example.

FIG. 27 is the perspective top view of the assembled parts including the seating base plate 5E, the seating back plate 12E and the supporting part 7E. The circle plates 33 are sandwiched between the seating base plate and the seating back plate. The supporting part 7*e* is connected with the knee front holder 6E and the hook portion 21E on the opposite end from the knee front holder is inserted into the space between the circle plates 33. And, FIG. 28 is the schematic diagram to show the seeing through arrangement of the seating base plate 5E, the seating back plate 12E, the circle plates 33 and the supporting parts 7E from the top surface in the fifth example. By choosing the circle plate to hang the hook portion 21E, the distance between the knee front holder and the seating base plate can be adjusted according to the length of the thigh. The circle plate 33 in the fifth example can be replaced with the pipe or the circle plate surrounded by the bearing, too.

SIXTH EXAMPLE

The sixth example of the present invention shows the easy structure to carry by making the seating apparatus possible to fold down the entire size to smaller one, and which is using a flexible material for connecting the seating base plate, the seating bottom plate and the tilting angle adjusting plate.

Figure 29:
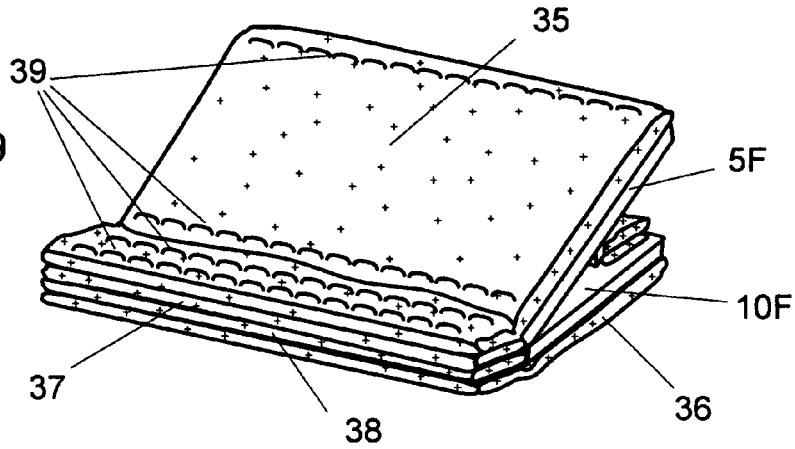
FIG. 29 is the perspective top view of the assembled parts including the seating base plate and the seating bottom plate in the sixth example.

FIG. 29 is the perspective top view of the sixth example from the diagonal front side direction, which shows the structure between the seating base plate 5F and the seating bottom plate 10F in the built up situation for the seating usage. And, FIG. 30 is the perspective view of the sixth example from the diagonal back side direction, which shows the structure between the seating base plate 5F, the seating bottom plate 10F and the tilting angle adjusting plate 40 in the built up situation as same as the FIG. 29.

Figure 30:
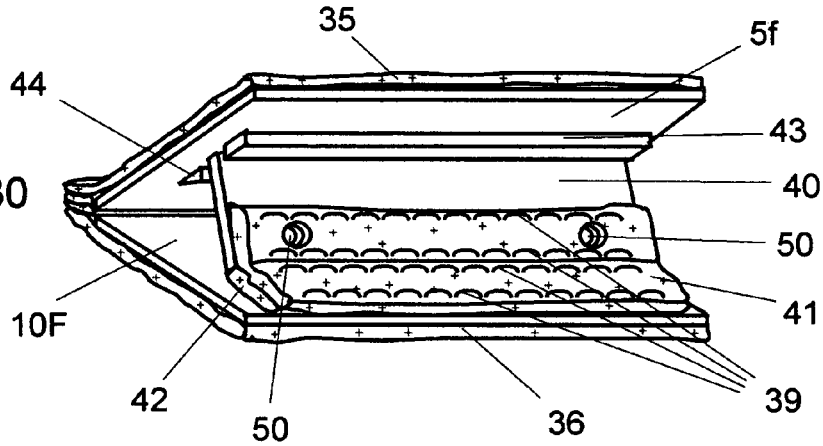
FIG. 30 is the perspective back view of the assembled parts including the seating base plate, the seating bottom plate and the tilting angle adjusting plate in the sixth example.

The relation between the seating base plate 5F and the seating back plate 10F in the built up situation can be seen in FIG. 30, in which the seating base plate 5F is supported to keep the tilting angle against the seating bottom plate 10F by the tilting angle adjusting plate 40 connected with the seating back plate.

Next, the structure to connect the seating base plate 5F and the seating back plate 10F is explained. The seating base plate connecting cloth 35 is stuck on the upper surface of the seating base plate 5F with the adhesive and extended in front of the seating base plate, and is sewed on the seating base plate to increase the connecting strength by the sewing thread 39 at the front and back tip portions of the seating base plate.

And, the seating bottom plate connecting cloth 36 is stuck on the back surface of the seating bottom plate 10F with the adhesive and extended in front of the seating bottom plate. The seating bottom plate connecting cloth 36 is also sewed on the seating bottom plate to increase the connecting strength by the sewing thread 39 at the front and back tip portions of the seating bottom plate as same as the seating base plate connecting cloth 35.

And, the both extended portions of the seating base plate connecting cloth 35 and the seating bottom plate connecting cloth 36 are sewed up to connect each other together with the seating base plate connecting spacer 37 and the seating bottom plate connecting spacer 38 inserted between the both connecting cloths. This tight connection of both cloths gives the freedom to increase or decrease the angle between the seating base plate 5F and the seating bottom plate 10F, but prevents to slide off or twist mutual positions. This connection has the feature of lighter weight compared to the connection by hinges and convenient for carrying.

Next, the cloth 41 for connecting the tilting angle adjusting plate is stuck on the tilting angle adjusting plate 40 with the adhesive and the thread 39 as shown in FIG. 30. And, the tilting angle adjusting plate 40 is connected with the seating bottom plate 10F by sewing the extended portion of the cloth 41 for connecting the tilting angle adjusting plate on the rear portion of the seating bottom plate 10F by the thread 39. The connecting spacer 42 for the tilting angle adjusting plate is inserted between the cloth for connecting the tilting angle adjusting plate and the rear portion of the seating bottom plate.

Figure 31:
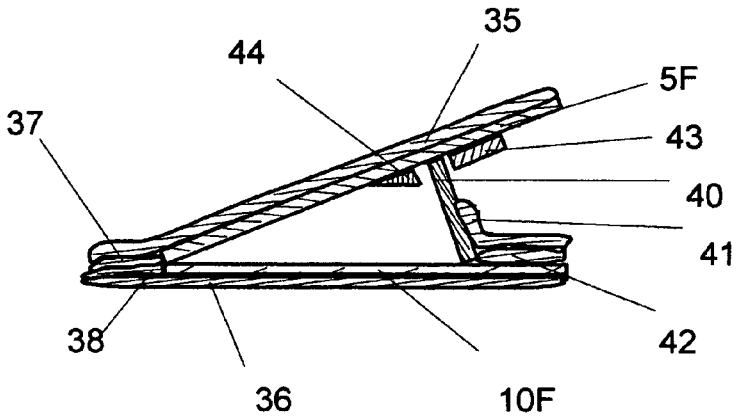
FIG. 31 is the section view of the assembled parts including the seating base plate, the seating bottom plate and the tilting angle adjusting plate in the sixth example.
Figure 32:
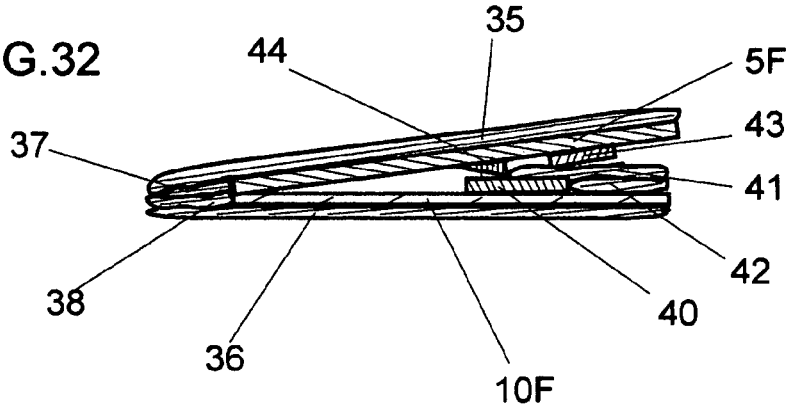
FIG. 32 is the section view of the assembled parts of the sixth example in the folded situation.

The opposite end portion of the tilting angle adjusting plate 40 is inserted between the position regulating bar A 43 and the position regulating bar B 44, and enables to keep the tilting angle of the seating base plate steadily. FIG. 31 is the schematic section view of the seating apparatus by the section plane perpendicular to the intersecting line between the seating base plate 5F and the seating bottom plate 10F , which shows the built up situation to be used for seating. On the other hand, the tilting angle adjusting plate 40 can be laid along the seating bottom plate 10F as shown in FIG. 32, which shows the schematic section view of the seating apparatus by the section plane perpendicular to the intersecting line between the seating base plate and the seating bottom plate, and on the situation for carrying. By laying down the tilting angle adjusting plate 40 and folding the seating base plate 5F, the outer size becomes thinner and convenient for carrying.

Figure 33:
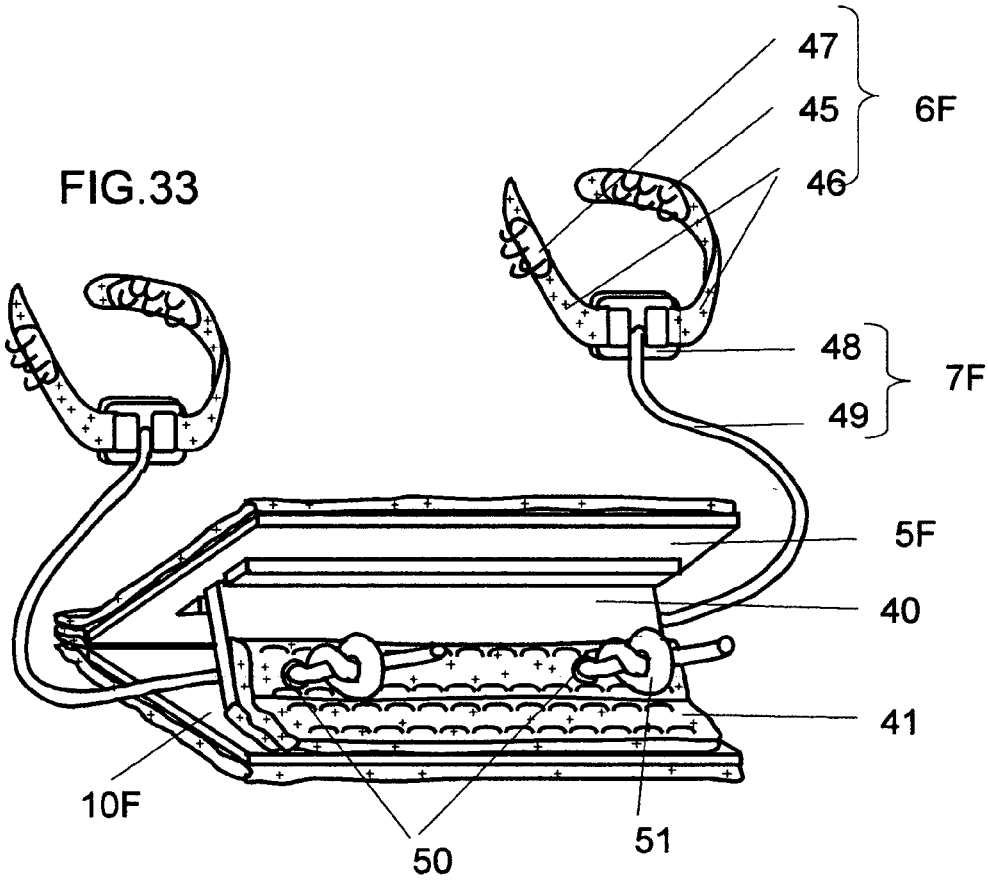
FIG. 33 is the perspective back view of the assembled parts including the seating base plate, the seating bottom plate, the tilting angle adjusting plate and the supporting parts with the knee front holder in the sixth example.

FIG. 33 shows the example to add the knee front holder 6F and the supporting part 7F onto the seating apparatus shown in FIG. 30. In this example, the knee front holder 6F is composed of the two knee belts 46, magic tape A 45 and magic tape B 47. The magic tape means a set of the tapes to connect each other by small hooks and curled hairs situated on each tape surface. In FIG. 33, magic tape A 45 has ring shaped hairs transplanted on the connecting surface, and magic tape B 47 has hooks transplanted on the connecting surface. The both knee belts with each magic tape at the respective tip portion are connected each other to cover around the knee front.

The supporting part 7F of the sixth example is composed of the joint plate 48 for the knee belt and the supporting cord 49. Another end portion of the knee belt 46 opposite from the end portion with magic tape A or B is connected with the joint plate 48 for the knee belt, and the joint plate for the knee belt is connected with the supporting cord 49. Another end portion of the supporting cord 49 opposite from the joint plate 48 for the knee belt is inserted into the hanging hole 50 for the supporting cord. The knot 51 is formed at the tip portion of the supporting cord 49. When the load of the body slipping down the seating base plate 5*f* is transferred to the supporting cord by covering around the knee with the knee belt 46 and connecting the both magic tapes, the knot 51 prevents the supporting cord 49 to come off the hanging hole 50.

Figure 34:
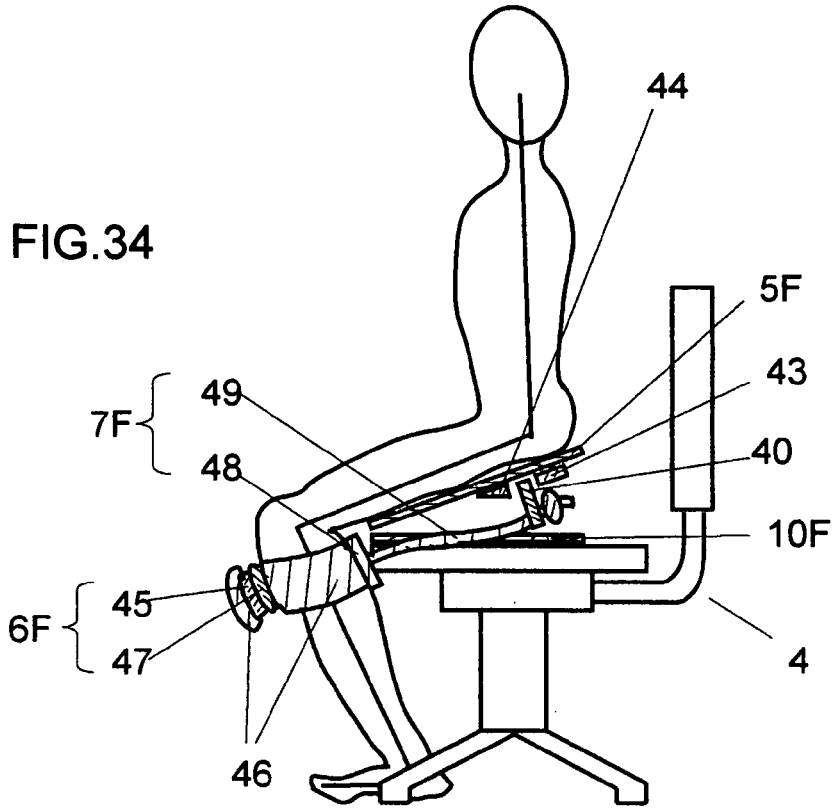
FIG. 34 is a schematic sectional view illustrating the posture of the person sitting on the office chair with the seating apparatus shown in the sixth example.
Figure 35:
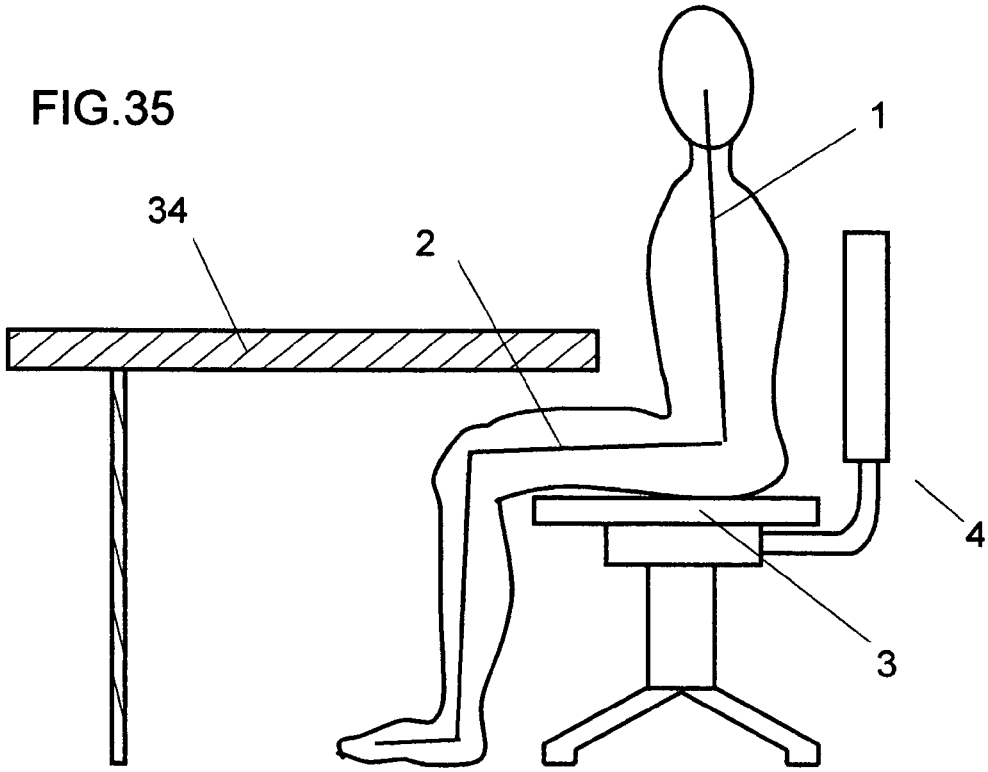
FIG. 35 is a schematic sectional view illustrating the posture of the person sitting on the conventional office chair in front of the desk.

By preventing the knot 51 come off the hanging hole 50, the load transferred to the supporting cord 49 is transferred also to the seating base plate 5F. And, by changing the position of the knot 51, the length of the supporting cord 49 can be changed according to the thigh length of sitting person. FIG. 34 is the schematic section view of the person who sits on the office chair by using the seating apparatus of the sixth example. And, in order to give a brief understanding for the total arrangement of the parts and their functions, only representative sections of the parts are gathered to explain without showing a section view literally in the one common plane. And, in order to make FIG. 34 easy to understand, the seating base plate connecting cloth 35, the seating bottom plate connecting cloth 36, the seating base plate connecting spacer 37, the seating bottom plate connecting spacer 38, the connecting cloth for the tilting angle adjusting plate 41, the connecting spacer for the tilting angle adjusting plate 42 and the sewing thread 39 are not shown. The knee front holder 6F is composed of the two knee belts 46, magic tape A 45 and magic tape B 47, and the two knee belts are connected in front of the knee by the connection of magic tapes.

The materials for the seating base plate connecting cloth 35, the seating bottom plate connecting cloth 36 and the cloth for connecting the tilting angle adjusting plate 41 in sixth example can be made of the thick cloth, which includes the cloths of high stiffness as used for a carpet or a bath mat. And the flexible materials including the ones called as the non-sewing cloth also can be used. The natural rubber, synthetic rubber and the cloth laminated with the resin film, including polyethylene and others, also can be used.

The materials for the seating base plate connecting spacer 37, the seating bottom plate connecting spacer 38 and the connecting spacer for the tilting angle adjusting plate 42 can be used the same ones as the seating base plate connecting cloth 35, and also the wooden plate or plastic plate with higher stiffness. The magic tapes to connect the both knee belts 46 can be replaced with a hook, a button, a fastener and other connecting parts for the cloths.

In the first to fifth examples described above, though the seating base plate 5 or the bonded seating back plate 12 with the seating base plate is connected with the seating bottom plate 10 by hinge, the present invention can be applied also for the case in which the angle between the seating base plate and the seating bottom plate is fixed without using the hinge. In another words, the angle between the seating base plate and the seating bottom plate can be fixed as, for example, 20 degrees only. In the first, second, fourth and fifth examples, it is also possible that the seating back plate serves as both a seating back plate and a seating bottom plate by making the plate section shape of triangle with the forward slanted angle of 20 degrees. And in the third example, it is possible to make the seating base plate itself to have the seating bottom surface of the seating bottom plate, and in which the seating base plate is formed by the block with the section shape of triangle and with forward slanted angle of 20 degree. The block with triangle section mentioned above can be replaced with the pipe of the triangle section shape, too.

The hinge connected between the seating bottom plate 10 and the seating base plate 5 or the seating back plate 12 bonded with the seating base plate can be replaced with the flexible material of cloth by applying the same method as described in the sixth example. And, it is also possible to apply the same method as the knee front holder 6F of the sixth example into the other example of the knee front holder. The knee front holder with the knee belt and the magic tapes can be used in the other example, too.

In order to increase the comfortableness on seating, it is possible to attach cushion materials such as rubber, sponge or cotton on the seating surface, and also to give the thickness gradation of the cushion being thinner in front side direction. In another words, it is possible to replace some part of the angle ranging from 5 to 45 degree by the thickness gradation angle of the cushion. By keeping the angle between the horizontal plane and the actual hips contact surface over the seating base plate in 5 to 45 degree, the advantage of the present invention is available.

The examples from the first to the sixth belong to the same group embodiment of the present invention, because the seating apparatus is used by setting on the sitting base plate of the conventional office chair 4 in all examples. On the other hand, the other group of the embodiment in the present invention is also possible, in which the chair structure to enable sitting by keeping the angle between the thigh and the spine from 95 to 135 degree is actualized from the beginning. In the latter embodiment, the seating bottom plate 10 is formed as the same one as the sitting base plate 3 of chair. Namely, the seating bottom plate 10 can be fixed onto the sitting base plate 3 by using the adhesive or by the bolt and nut. The connecting portion of the hinge 8 opposite from the seating back plate 12 in the first to fifth example or the seating base plate connecting cloth 35 in the sixth example can be fixed directly to the sitting base plate 3 without using the seating bottom plate 10. In the case to install the function of the present invention into the chair structure from the beginning, the structures of the upper position from the hinge 8 or the seating base plate connecting cloth 35 in the first to sixth examples can be adopted.

I claim:

1. A seating apparatus composed of at least a seating base plate, a seating bottom plate, a tilting angle adjusting plate, a knee front holder and a supporting part connected with the said knee front holder, wherein the seating apparatus can be removed from one chair to another chair; and wherein a tilting angle between the seating base plate and the seating bottom plate can be controlled from 5 to 45 degrees to make the seating base plate slant lower at a sitting front side of the seating apparatus in seating use time; and wherein the tilting angle between the seating base plate and the seating bottom plate can be adjusted by setting the tilting angle adjusting plate situated between the seating base plate and the seating bottom plate in seating use time; and wherein the tilting angle adjusting plate can be folded in non-seating use time to make the tilting angle between the seating base plate and the seating bottom plate smaller than the tilting angle kept in seating use time; and wherein the knee front holder is connected with the supporting part, and the supporting part is connected with the seating base plate or a load transferable portion to the seating base plate at an opposite end portion to the knee front holder; and wherein the load transferable portion to the seating base plate is defined as a portion to transfer some part of a seating person's body weight by mechanical intermediation between the seating base elate and the supporting part; and wherein the connection between the supporting part and the seating base plate or the load transferable portion to the seating base plate is made by a half fixed joint; and wherein the knee front holder contacts with a knee front of the seating person, and some part of the seating person's body weight is transferred to the knee front holder through the knee front in seating use time along with the seating person's body slipping down forward on the seating base plate; and wherein the half fixed joint enables the supporting part to connect and disconnect with the seating base plate or the load transferable portion to the seating base plate; and wherein a maximum capable distance of the knee front holder to be away forward from the seating base plate is restricted through the supporting part by the half fixed joint between the supporting part and the seating base plate or the load transferable portion to the seating base plate in seating use time; and wherein the maximum capable distance of the knee front holder to be away forward from the seating base plate is set by adjusting the length of the supporting part and connecting the supporting part with the seating base plate by the half fixed joint to prevent the seating person's body slip forward down on a surface of the seating base plate; and wherein the knee front holder is made of a cloth; and wherein the seating base plate and the seating bottom plate are connected by a seating base plate connecting cloth and a seating bottom plate connecting cloth with a sewed thread; and wherein the tilting angle adjusting plate is connected with the seating bottom plate by a cloth.

2. The seating apparatus according to claim 1, wherein the half fixed joint is made of a hook.

* * * * *